US009180460B2

(12) United States Patent
Zilberberg

(10) Patent No.: US 9,180,460 B2
(45) Date of Patent: Nov. 10, 2015

(54) APPARATUS AND METHOD FOR TRANSFERRING TEST TUBES

(76) Inventor: Amir Zilberberg, Tel Aviv (IL)

( * ) Notice: Subject to any disclaimer, the term of this patent is extended or adjusted under 35 U.S.C. 154(b) by 0 days.

(21) Appl. No.: 14/236,158

(22) PCT Filed: Sep. 5, 2012

(86) PCT No.: PCT/IL2012/000327

§ 371 (c)(1),
(2), (4) Date: Jan. 30, 2014

(87) PCT Pub. No.: WO2013/042105

PCT Pub. Date: Mar. 28, 2013

(65) Prior Publication Data

US 2014/0178269 A1 Jun. 26, 2014

(30) Foreign Application Priority Data

Sep. 20, 2011 (IL) ..... 215257

(51) Int. Cl.
*B01L 9/06* (2006.01)

(52) U.S. Cl.
CPC ..... *B01L 9/06* (2013.01); *B01L 2300/0803* (2013.01); *B01L 2300/123* (2013.01)

(58) Field of Classification Search
CPC ..... B01L 9/06
USPC ..... 422/562
See application file for complete search history.

(56) References Cited

U.S. PATENT DOCUMENTS 5,720,406 A * 2/1998 Fassbind et al. ..... 220/23.4
2010/0298108 A1* 11/2010 Sherman et al. ..... 494/20

* cited by examiner

*Primary Examiner* — Paul Hyun
(74) *Attorney, Agent, or Firm* — Eric Karich; Karich & Associates

(57) ABSTRACT

An apparatus has a) a flat, flexible test tube holder ring, and b) a mechanism to manipulate the angular orientation of the flat flexible test tube holder ring. The test tube holder ring includes: (1) an outer circumference, (2) an inner circumference, and (3) apertures to hold test tubes, wherein alternate apertures have circumferential walls to enable positioning the test tubes higher compared to their adjacent test tubes. The mechanism includes an engagement mechanism that orients the angle of the test tube holder ring. When the test tube holder ring is at one angle, the test tube holder ring is flat and planar, and when the test tube holder is at a different angle the test tube holder ring has a conical shape.

11 Claims, 5 Drawing Sheets

APPARATUS AND METHOD FOR TRANSFERRING TEST TUBES

FIELD OF THE INVENTION

The present invention generally relates to accessories for use in conjunction with a centrifuge, and more particularly, to an apparatus, and method for simultaneously holding groups of test tubes in a test tube holder in a vertical position and transferring these into and retrieving them from a centrifuge.

BACKGROUND OF THE INVENTION

It is customary at present to place test tubes in an upright position in a rectangular rack, and after adding samples and/or reagents into the test tubes, to manually transfer each test tube separately into cells of a circular centrifuge at an angle. As a result, there is a problem of time wasted in transferring the test tubes one by one into the centrifuge. There are many kinds of centrifuges; the most common ones contain either 24 or 36 cells for test tubes. It is important to point out that the centrifuge cells are set at an angle and, therefore, the test tubes are required to be inserted therein a at about a 45-degree angle. The use of Eppendorf centrifuge test tubes and suitable centrifuges are very common in research laboratories and medical institutions worldwide.

The Eppendorf centrifuge tube has become a generic trademark for microfuge tubes or microcentrifuge tubes. They are small, cylindrical plastic containers with conical bottoms, typically with an integral snapcap, disposable and inexpensive. They are used in molecular biology and biochemistry to store and centrifuge small amounts of liquid. They are used by many chemists and biologists as convenient sample vials in lieu of glass vials and are particularly useful when there is only a small amount of liquid sample or when small amounts of reagents are to be added, because microcentrifugation can be used to collect the drops at the bottom of the tube after pipetting or mixing. Eppendorf is a major manufacturer of test tubes of this type, but it is not the only one. A typical table-top laboratory centrifuge today is provided with a circular rotor (see, for example, the Ohne FC&W model EBA 12R centrifuge). The rotor is conical providing a 45-degree slope for the cells into which the test tubes containing samples are to be inserted for centrifuging.

As mentioned earlier, one problem with such a centrifuge method is that much time is needed to place each test tube individually into the cells of the rotor. Furthermore, the current method of using a rectangular test tube racks makes it impossible to place the test tubes directly from the rack into a conical, i.e., circular, rotor of a centrifuge.

The present invention comes to solve this problem by providing a flexible, test tube holder ring which, when placed lying flat on a corresponding round rack, can accommodate a number of test tubes inserted vertically, and when these are to be transferred to a centrifuge by means of the holder ring, the test tubes are pivoted at an angle to match the angle of the conical centrifuge cells due to the change in shape of the flexible, flat holder ring. Moreover, when retrieving the test tubes from the centrifuge, the flexible holder ring is able to adjust its angle to accommodate the angle of the test tubes as these are removed from the angular centrifuge cells.

The prior art that relates to the field of the present invention includes: U.S. Pat. No. 3,361,343; U.S. Pat. No. 3,713,771; U.S.2006/0198759, U.S.2010/0031760 A1; U.S.2010/0314344 A1 and DE 3217625 A1. All these patents provide racks for receiving test tubes for centrifuging and inserting them into a centrifuge at an angle. The '771, '760, and DE patents in particular, relate to flexible holders for centrifuge test tubes.

It should be noted that the problem which the present invention comes to solve also relates to the removal of test tubes from a centrifuge without the need for individual manipulation of each test tube. With specific reference to U.S. patent application 2010/0031760, this prior art teaches the use of a flexible strip test tube holder that can change its shape and assume a conical shape having an angle corresponding to that of a centrifuge rotor. The flexible strip has an additional rib by which it is wedged into a corresponding recess in the centrifuge. In standard, legacy centrifuges, however, this recess does not exist and therefore in order to use this flexible strip the centrifuge apparatus requires modification, limiting the usefulness of this test tube holder, since it is unsuited for the most common types of centrifuges in use today. In contrast, the present invention is suited for use with most centrifuges that are found in a majority of laboratories. There is no need, as in the previous case, for changes or adaptations in existing legacy systems.

In addition, the flexible strip of the above-mentioned, patent publication, because it is a strip and not a ring, enables simple entry of all the test tubes at one time into corresponding designated cells in a centrifuge. This entry is effected with the assistance of an additional hard strip that is not flexible. The difficulty is that such an arrangement does not allow simultaneous removal of all the test tubes that are aligned in a circle in the centrifuge, as a group. There is no provision for holding the strip in order to pull it out of a centrifuge. Moreover, there is no provision for allowing withdrawal of all the test tubes together in a cyclic manner (upward and inward, as explained hereinafter).

In contrast, the present invention enables vertical and angular movement of all the test tubes (or centrifuge tubes) together in a circular manner. Thus all the test tubes may also be removed at one time and transferred as a group to a rack.

In short, the problem which the present invention addresses is not only the entry of the test tubes into a centrifuge rotor at an angle, a problem which has been solved in many ways, but in their simultaneous removal. The solution to the problem provided by the present invention is unique and comprehensive and applicable to commercial centrifuges available in the vast majority of laboratories and institutions worldwide.

It is therefore, desirable to provide an inexpensive and efficient apparatus, system, and method that will allow the simple entry and removal, respectively, of all the test tubes into and from, a centrifuge simultaneously, without the necessity of handling each test tube individually.

Furthermore, the present invention comes to orient the test tubes into a ready position for simultaneous entry into and removal from the apertures of a centrifuge rotor. This additionally overcomes the problem of individual, time-wasting handling and positioning of the test tubes as is generally done today. After centrifuging, the test tubes can be conveniently and simultaneously lifted out of the centrifuge and returned to a rack for further inspection and processing as needed.

The present invention further involves providing a round test tube rack suitable for holding test tubes for transfer and retrieval from standard centrifuges.

SUMMARY OF THE INVENTION

Accordingly, it is a principle object of the present invention to provide an apparatus for holding groups of test tubes, specifically centrifuge tubes, in a round test tube holder for simultaneous transfer to and from a centrifuge.

It is a further object of the present invention to provide a flexible flat test tube holder ring to accommodate a group of centrifuge tubes inserted in an upright position in a round rack and transfer the centrifuge tubes at an angle into a centrifuge rotor.

Another object of the present invention is to provide a lifting mechanism for lifting the flexible test tube holder ring with centrifuge tubes out of a round stand and transfer them as a group to a centrifuge at an angle by flexing the holder ring to form a conical shape corresponding to the rotor of the centrifuge, and retrieving them therefrom.

Yet another objective of this invention is to provide a round test tube rack for holding test tubes held in a round flat ring.

In accordance with the present invention there is provided a transfer apparatus, comprising:

a. a flat planar flexible test tube holder ring comprising;
   1. an outer circumference,
   2. an inner circumference, and
   3. apertures therebetween to hold test tubes, and b. a manipulating mechanism connected to the planar holder ring to manipulate the angular orientation of the plane of the holder ring, said mechanism comprising, multiple arms equidistantly and pivotally connected to a hub, said arms having terminal ends equidistantly and pivotally engaging the test tube holder ring at its inner circumference, The arms may be permanently or releasable connected to the test tube holder ring.

so that when the arms extending from the hub are pressed down, the planar angle of the test tube holder ring is changed as well, giving the holder ring a conical shape.

In a preferred embodiment, there is provided a pressure ring disposed over the hub and arms for applying even pressure on the arms, thus assuring even angular orientation of the planar test tube holder ring. The pressure ring may have means to releasably engage the arms.

The multiple arms are rigid arms are pivotally connected to the ring and to the hub which is preferably in the form of a rigid ring, Squeezing the arms will force the test tube holder ring to adopt an angle as well. This angle can vary depending on the pressure applied to the arms. The hub gives structural support to the arms. The further the ring is lowered over the arms the steeper the angle of the test tube holder ring. Thus the pressure means can regulate the angle of test tubes held in the test tube holder ring.

A handle can be attached to the apparatus, preferably to the hub, The handle comprises two symmetrical parts and is preferably designed to facilitate equal distribution of pressure over all the arms.

The present invention also provides a method for transferring a group of filled test tubes, preferably centrifuge tubes simultaneously from a rack into a centrifuge rotor by pivoting them at an angle of about 45-degree to efficiently insert them into the cells of the rotor, and to remove them together and re-orient them in an upright position for placement in a rack for further handling. This not only precludes the necessity of handling each test tube separately, but more important, saves much time over current practices.

The method is as follows. Centrifuge tubes containing samples for centrifuging are loaded vertically into the test tube holder ring of the transfer apparatus over an appropriate round rack and a mechanism to manipulate the angle of the holder ring is attached to the test tube holder ring, in accordance with this invention. The vertically oriented centrifuge tubes in the holder ring are positioned over the opening of the cells of a centrifuge. Manual pressure is applied to the arms of the manipulating mechanism which inclines the test tube holder ring and test tubes at an angle, enabling lowering the centrifuge tubes into the cells. This angle is manipulated to about 45 degrees so that the test tubes are lowered directly into their respective cells.

After centrifuging the process is reversed, the activating mechanism is connected to the test tube holder ring, pressure is applied to the test tube holder ring by the manipulating means, and the test tube holder ring with the test tubes is lifted out of the rotor at an angle slowly releasing the pressure on the arms to bring the test tubes to a vertical orientation and transferring them to a rack.

In one embodiment the test tube holder ring with the test tubes can be retrieved from the rotor by pushing the tabs and pulling the handle of the pressure ring concurrently.

Further features and advantages of the present invention will be apparent from the appended drawings and the detailed description given hereinafter.

BRIEF DESCRIPTION OF THE DRAWINGS

For a better understanding of the invention with regard to the embodiments thereof, reference is made to the accompanying drawings in which like numerals designate corresponding elements or sections throughout and in which.

DETAILED DESCRIPTION OF THE EMBODIMENTS

Figure 1:
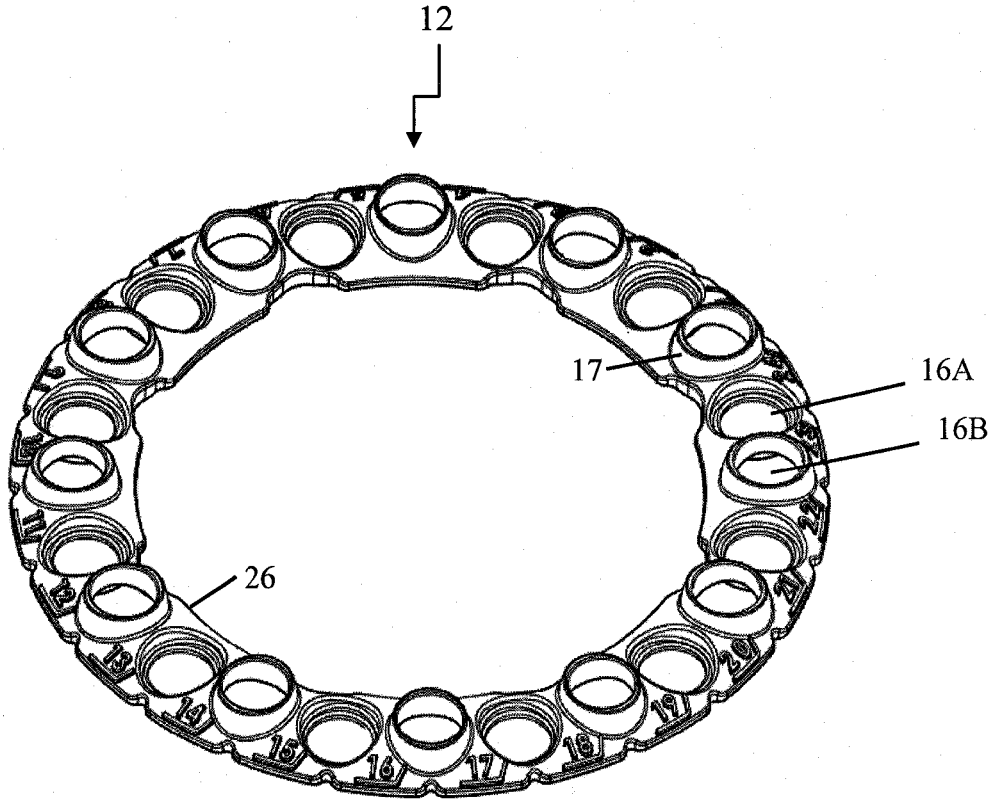
FIG. 1 illustrates a flexible flat planar test tube holder ring in accordance with the present invention.
Figure 2:
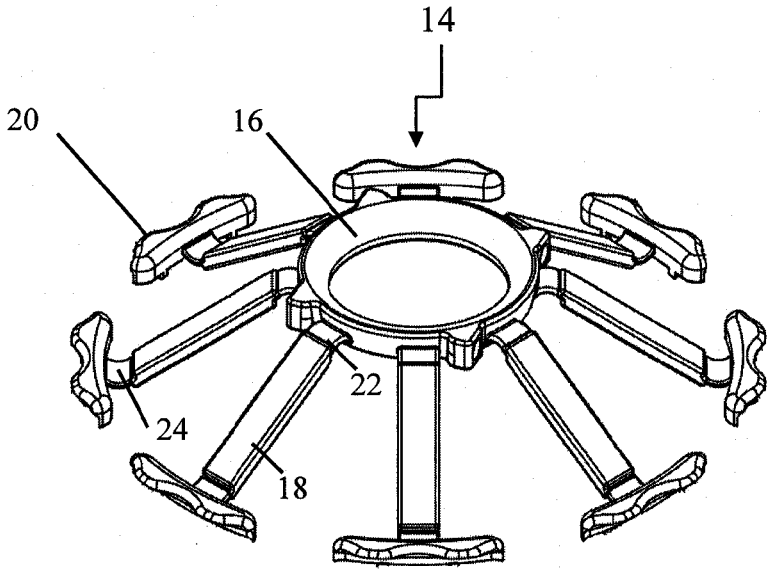
FIG. 2 shows the manipulating mechanism for manipulating the test tube holder ring of FIG. 1.
Figure 3:
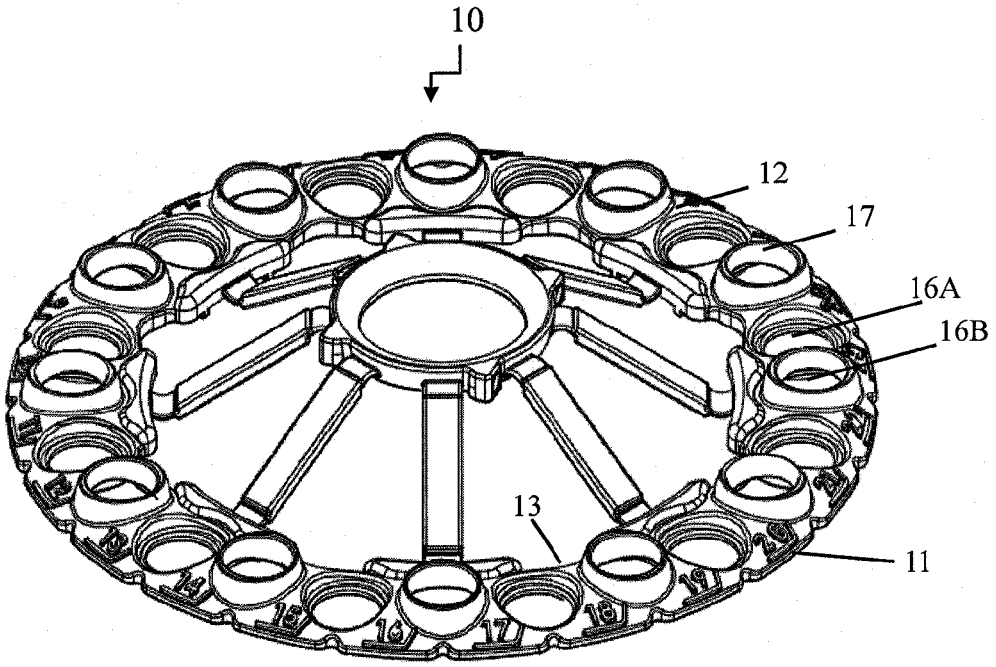
FIG. 3 is a perspective view of an apparatus in accordance with a first embodiment of the present invention.
Figure 4:
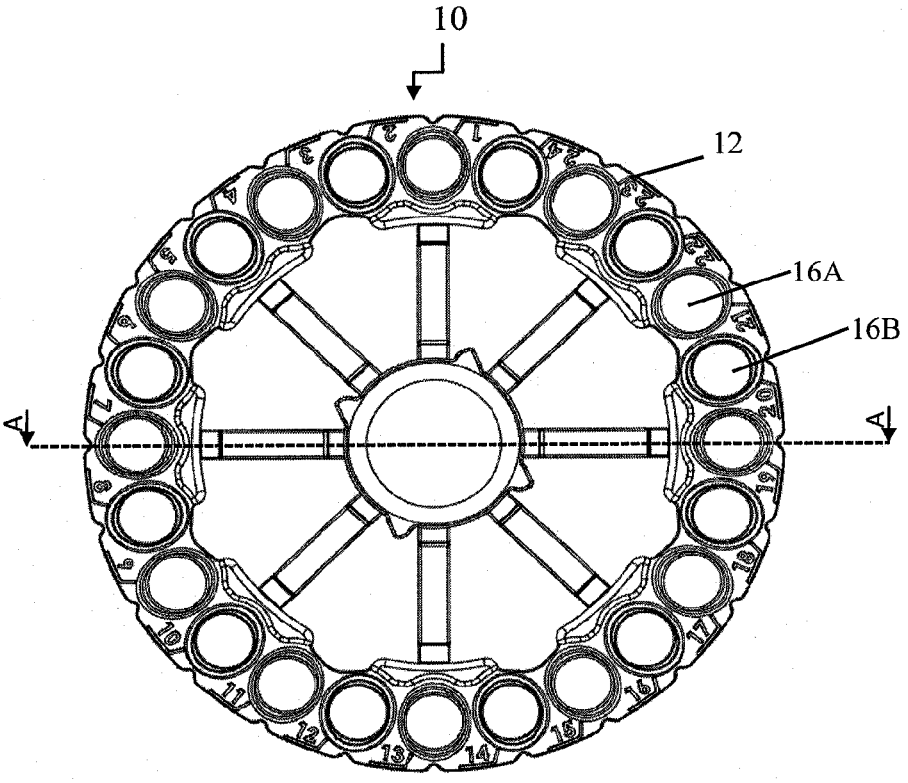
FIG. 4 is a top view of the apparatus of FIG. 3.

With reference to the figures, FIGS. 1 to 4 show a first embodiment of the present invention. The apparatus 10 (FIG. 3) comprises a flat, flexible test tube holder ring 12, (FIG. 1) and manipulating mechanism 14 (FIG. 2). The test tube holder ring 12 has an outer circumference 11 and an inner circumference 13 and can be made from any flexible material such as rubber, polyethylene, polyurethane, silicones and the like. The ring 12 comprises equidistantly spaced-apart apertures 16A, 16B . . . 16*n* into which test tubes are inserted. The number "n" of apertures can vary as can the size of the holder ring depending on the number of cells in the centrifuge into which the test tubes are to be placed. The apertures are generally round and are smaller in diameter than the lips of test tubes so that the test tubes will be supported within the ring 12.

In a preferred embodiment alternate test tube aperture 16B are slightly elevated above their adjacent aperture 16A, and so on, to enable positioning alternate test tubes slightly higher than adjacent test tubes. This is particularly useful for test tubes having lids over their opening. This way, the lids of adjacent test tubes are not on the same plane and do not collide with each other, such an arrangement enables the ring 12 to have the maximum possible number of test tubes along its circumference but at the same time to have some free space between adjacent test tubes. The free space between adjacent test tubes is highly essential for enabling the test tubes to get closer together while pressing ring 12 and pulling it out of the centrifuge rotor. This way, the shape of ring 12 is not distorted, and ring 12 stays flat and stable while being pulled out.

Thus, in accordance with some embodiments of the present invention, test tube holder ring 12 is designed in a way that apertures 16B have circumferential walls 17 where the circumference of the walls 17 is smaller than the lips of the test tubes so that the walls 17 support the test tubes, and thus, enable positioning the test tubes slightly higher compared to their adjacent test tubes which are inserted in apertures 16A.

The mechanism 14 to manipulate the flexible test tube holder ring 12 comprises a hub 16, preferably in the form of a ring from which extend uniformly spaced-apart arms 18 that terminate in connectors 20. The arms 18 are hingedly 22, 24 attached to the hub element 16 and to the connectors 20, respectively. The arms 18 can thus be flexed to form a downward angle with respect of the hub 16 and an upward angle with respect of the connectors 20. The apparatus 10 is assembled by attaching (either permanently or releasably) the connectors 20 to the test tube holder ring 12 around its inner circumference 26.

Figure 5:
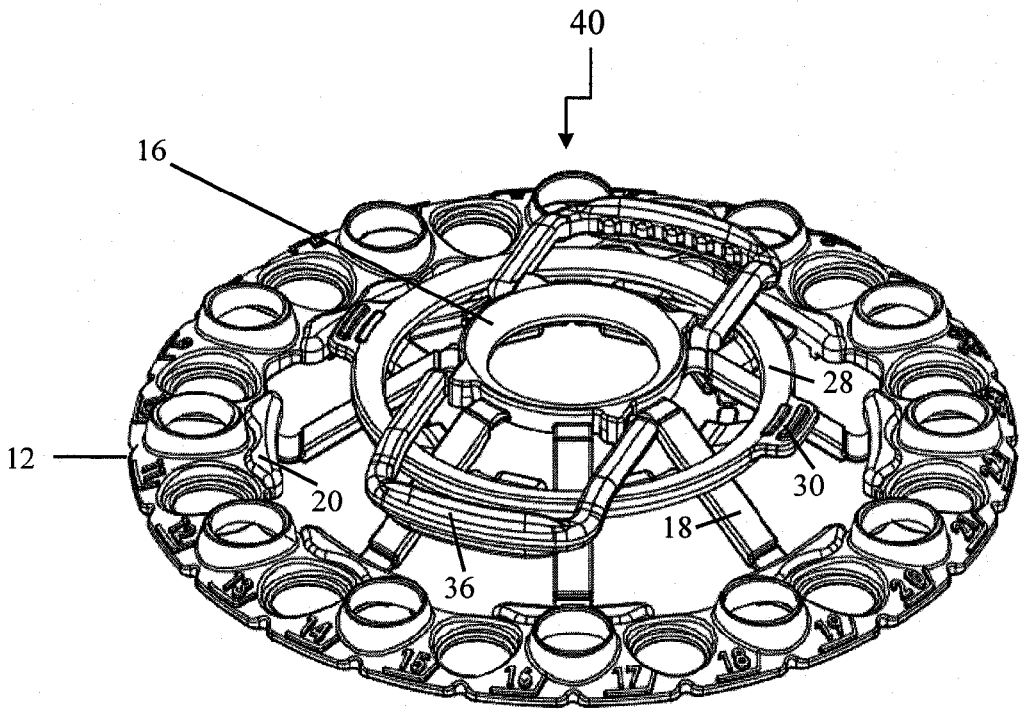
FIG. 5 illustrates an apparatus in accordance with another embodiment of the invention.

The apparatus 10 can control the angle of the surface of the test tube holder ring 12 by exerting pressure on the arms 18 reducing their extended circumference thereby flexing the test tube holder ring 12 inwards at an angle dependent on the pressure exerted. FIG. 5 illustrates apparatus 40 in accordance with another embodiment of the present invention. In apparatus 40, the flexible test tube holder ring 12, the hub 16, arms 18 and connectors 20 are the same as in FIGS. 1-4.

Figure 6:
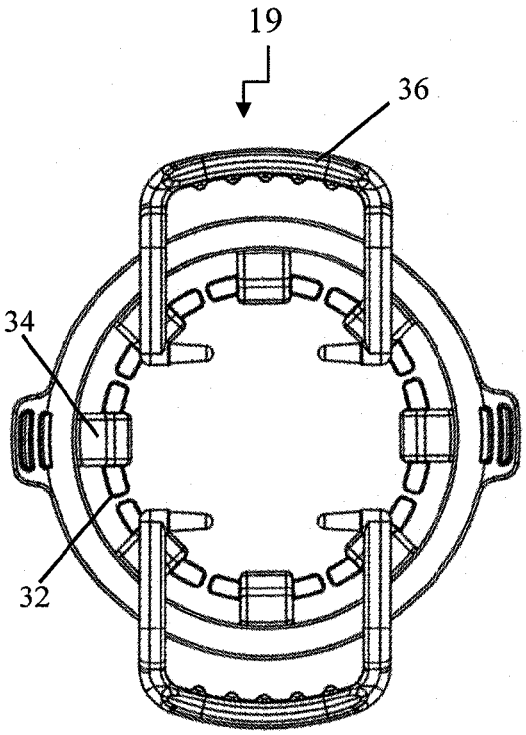
FIG. 6 is a top view of the pressure ring shown in FIG. 5.

FIG. 6 illustrates another embodiment of a pressure ring mechanism 19 for orienting the test tube holder ring 12. Mechanism 19 comprises a pressure ring 28 disposed over the hub 16 and arms 18. The pressure ring 28 enables applying even pressure to the arms 18. The pressure ring 28 has two opposite tabs 30 extending therefrom to facilitate pressing down on the arms 18. In addition, struts 34 extend downwards from the ring 28 and terminate with terminal T shaped tabs 32. The pressure ring 28 is placed over the hub 16 and arms 18 with the struts 34 between the arms 18 and the tabs 32 are pressed to fit under two adjacent arms 18 thus loosely attaching the pressure ring 28 to the lifting mechanism 14.

The role of the tabs 32 under the arms 18 is to secure the pressure ring 28 to the lifting mechanism 14 for applying even pressure and not be easily separated therefrom. The pressure ring 28, struts 34 and tabs 32 are rigid or semi-rigid, and preferably made of rigid plastic. A carrying handle 36 may also be added to the apparatus for ease of transporting and lifting. The handle 36 comprises two symmetrical parts and can be foldable. The handle 36 is preferably designed to facilitate equal distribution of pressure over all the arms.

Figure 7:
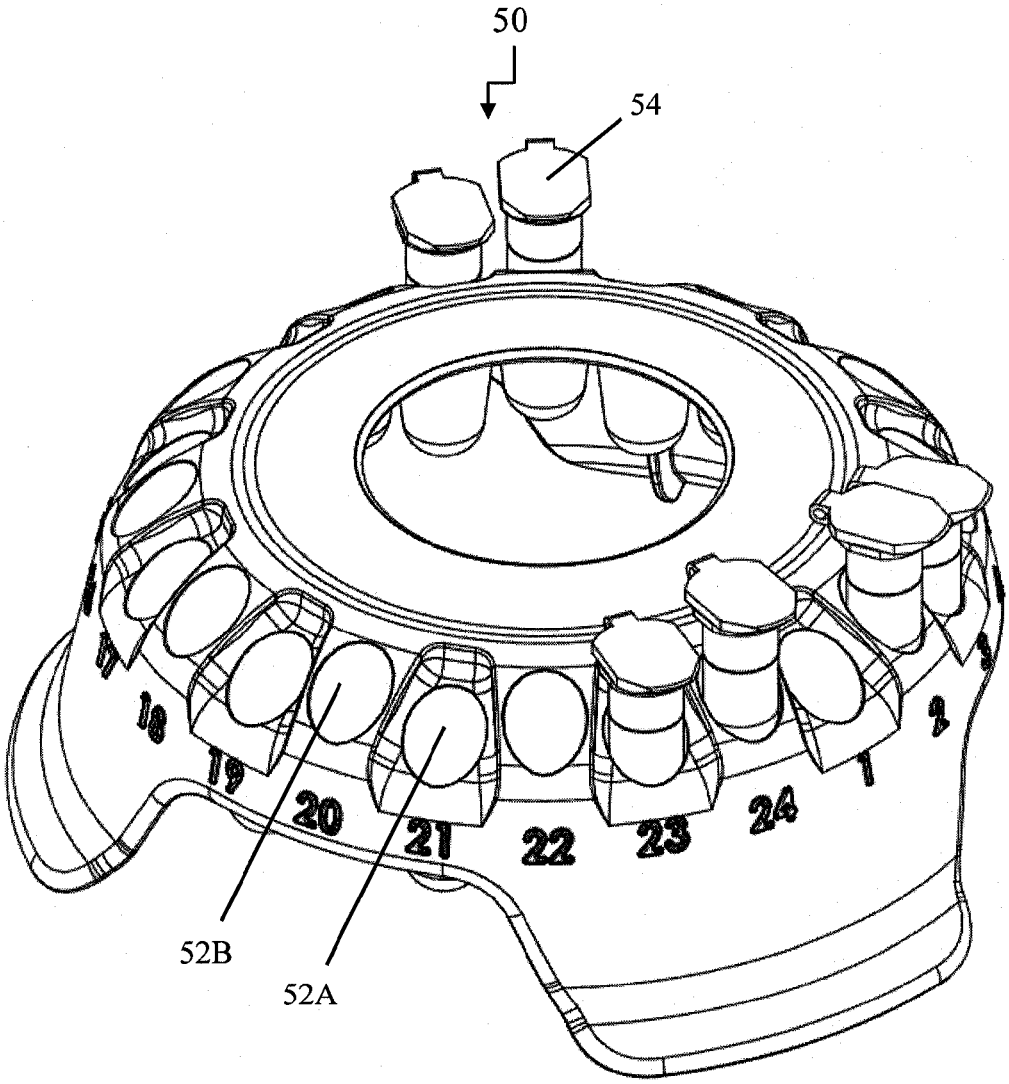
FIG. 7 illustrates a round stand for centrifuge tubes transferred with apparatuses of FIGS. 3-5.

FIG. 7 illustrates a stand 50 in accordance with the present invention.

Stand 50 is positioned on the work surface and preferably near a centrifuge and can receive single or multiple test tubes. Stand 50 is specifically useful for holding test tubes in a test tube holder ring 12 or in an apparatus 10 or 40. The stand 50 comprises equidistant, spaced-apart apertures 52A and 52B into which test tubes 54 are inserted, and similar to ring 12, stand 50 is designed in a way that the opening of alternating apertures 52B is slightly higher than the opening of adjacent apertures. Such design enables the test tubes to fit stably in the corresponding apertures of stand 50. It should be noted, however, that stand 50 may be designed to have the opening of all apertures on the same height level Either way, apparatus 40 (or apparatus 10) may fit into stand 50 as the test tubes do not have to tightly fit into the corresponding apertures of stand 50, instead, keeping the test tubes vertical is most important here.

Stand 50 may be made from rigid or semi-rigid materials such as metals, wood plastics and other suitable materials.

Figure 8:
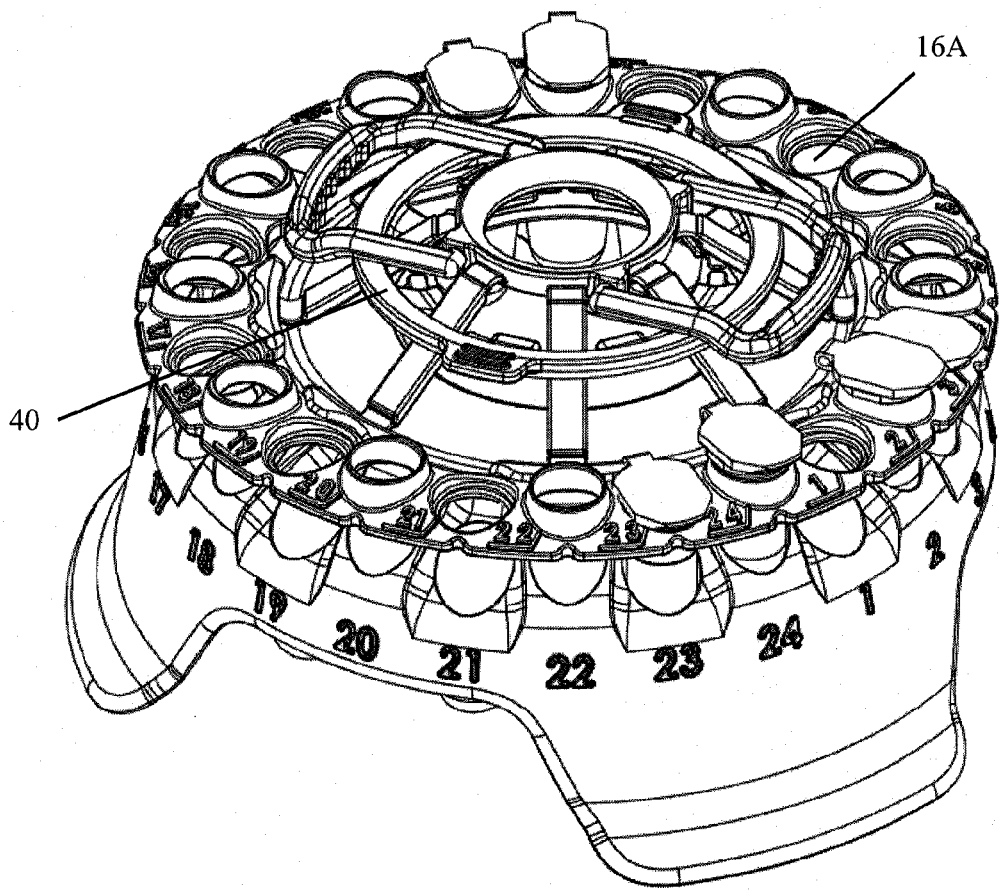
FIG. 8 illustrates the apparatus of FIG. 5 mounted on the stand of FIG. 7.

FIG. 8 illustrates a stand 50 with apparatus 40 loaded with test tubes held therein.

Stand 50 enables keeping the test tubes vertical after centrifuging until further actions are taken. This is essential since tilting the test tubes after centrifuging may re-suspend their content requiring repeating the centrifugation.

The method of using the complete apparatus of this invention is as follows. Prior to centrifuging, the user places an apparatus 40 on top of stand 50 aligning the apertures 16A . . . 16*n* over apertures 52A . . . 52*n* and insert test tubes through these apertures. Apparatus 40 is transferred with the test tubes 52A . . . 54*n* to a centrifuge rotor because the centrifuge cells 52A . . . 52*n* in the centrifuge are at an angle, the test tube holder 12 is oriented to hold the test tubes at an angle with the aid of the pressure ring 28. After centrifuging, the apparatus 40 is lifted with the tubes at an angle and position it upright in stand 50.

As seen in FIGS. 1, 3-5, 7 and 8, the apertures in ring 12 and in stand 50 are labeled. This may be convenient to avoid confusion by enabling positioning of the test tubes in their original positions in stand 50 after centrifuging.

What is claimed is:

1. An apparatus for manipulating test tubes, the apparatus comprising:

a) a flat, flexible test tube holder ring comprising;

1. an outer circumference,
2. an inner circumference, and
3. apertures to hold the test tubes, wherein alternate apertures have circumferential walls to enable positioning the test tubes higher compared to their adjacent test tubes; and b) a mechanism to manipulate the angular orientation of the flat flexible test tube holder ring, said mechanism comprising a means to engage and to orient the angle of the test tube holder ring, so that when the angle of the means to engage and to orient the angle of the test tube holder ring is at one angle, the test tube holder ring is flat and planar, and when the angle of the means to engage and to orient the angle of the test tube holder is at a different angle the test tube holder ring has a conical shape.

2. The apparatus according to claim 1, wherein the apertures in the flexible test tube holder ring are labeled.

3. The apparatus according to claim 1, wherein the apertures in the flexible test tube holder ring are round.

4. The apparatus according to claim 1, comprising a handle to carry the apparatus.

5. The apparatus of claim 1 further comprising:

a stand having a round test tube holder comprising equidistant, spaced-apart apertures to receive either single test tubes or the apparatus.

6. The apparatus of claim 5, wherein the stand is made from rigid or semi rigid materials.

7. The apparatus of claim 5, wherein the apertures of the stand are labeled.

8. A method for moving test tubes to a centrifuge, the method comprising the steps of:

providing an apparatus comprising a flat, flexible test tube holder ring, having an outer circumference, an inner circumference, and apertures to hold the test tubes, wherein alternate apertures have circumferential walls to enable positioning the test tubes higher compared to their adjacent test tubes, the apparatus further including a mechanism to manipulate the angular orientation of the flat flexible test tube holder ring, said mechanism comprising a means to engage and to orient the angle of the test tube holder ring, so that when the angle of the means to engage and to orient the angle of the test tube holder ring is at one angle, the test tube holder ring is flat and planar, and when the angle of the means to engage and to orient the angle of the test tube holder is at a different angle the test tube holder ring has a conical shape;

inserting the test tubes into the apertures of the apparatus;

lifting, transferring, and holding the apparatus above the centrifuge;

applying pressure on a flexing means to orient said flat, flexible test tube holder to have a shape of a trimmed cone;

inserting simultaneously the test tubes into the corresponding cells of said centrifuge; and applying, when the operation of said centrifuge is completed, pressure on said flexing means to slightly increase the orientation angle of the test tubes and simultaneously pulling the test tubes out of the cells.

9. The method according to claim 8, wherein the flexing means includes at least one tab, and wherein the step of applying pressure on said flexing means is carried out by pressing the at least one tab.

10. The method according to claim 8, wherein lifting and transferring the apparatus is done by holding a handle.

11. The method according to claim 8 further comprising positioning the apparatus on top of a stand and inserting the test tubes into apertures of the stand prior to inserting/removing test tubes into/from the apertures of the flexible test tube holder ring.

* * * * *